US009393968B2

(12) United States Patent
Mollet et al.

(10) Patent No.: US 9,393,968 B2
(45) Date of Patent: Jul. 19, 2016

(54) CABLE TRANSPORT INSTALLATION

(71) Applicant: POMAGALSKI, Voreppe (FR)

(72) Inventors: Alain Mollet, Voreppe (FR); Eric Blanc, Voreppe (FR)

(73) Assignee: POMAGALSKI, Voreppe (FR)

( * ) Notice: Subject to any disclaimer, the term of this patent is extended or adjusted under 35 U.S.C. 154(b) by 0 days.

(21) Appl. No.: 13/937,458

(22) Filed: Jul. 9, 2013

(65) Prior Publication Data

US 2014/0013992 A1 Jan. 16, 2014

(30) Foreign Application Priority Data

Jul. 10, 2012 (FR) ..... 12 56648

(51) Int. Cl.

| | |
|---|---|
| ***B61B 12/00*** | (2006.01) |
| ***B61B 12/10*** | (2006.01) |
| ***B61B 9/00*** | (2006.01) |
| ***B61B 13/08*** | (2006.01) |

(52) U.S. Cl.

CPC . *B61B 12/10* (2013.01); *B61B 9/00* (2013.01); *B61B 13/08* (2013.01)

(58) Field of Classification Search

CPC ..... B61B 12/10; B61B 12/12; B61B 12/125; B61B 12/127; B61B 9/00; B61B 13/08; B61B 13/105

USPC ..... 104/118, 119, 120, 165, 172.3, 178

See application file for complete search history.

(56) References Cited

U.S. PATENT DOCUMENTS

| | | | | | |
|---|---|---|---|---|---|
| 1,386,534 | A | * | 8/1921 | Rogers | B61B 7/02 104/235 |
| 3,190,235 | A | * | 6/1965 | Bertin | B60T 1/14 104/134 |
| 3,812,788 | A | * | 5/1974 | Laurent | B61B 9/00 104/130.09 |
| 3,915,094 | A | * | 10/1975 | Sawada | B61F 9/00 104/130.07 |
| 4,550,663 | A | * | 11/1985 | DeViaris | B60V 3/04 104/119 |

(Continued)

FOREIGN PATENT DOCUMENTS

| | | | |
|---|---|---|---|
| CH | 692732 | A5 | 10/2002 |
| EP | 0611220 | A1 | 8/1994 |

(Continued)

*Primary Examiner* — Jason C Smith

(74) *Attorney, Agent, or Firm* — Bachman & LaPointe, P.C.

(57) ABSTRACT

The transport system in accordance with the invention comprises a car for receiving passengers, a guidance system and a cable traction system. The transport system is characterized in that the guidance system is constituted of a single central rail on which roll wheels attached to the car. Thus, there is no longer any lateral wall to support the guide rail or rails, which makes it possible to limit the width of the roadway neutralized by the system. The wheels of the car may be located laterally on each side of the central rail.

13 Claims, 5 Drawing Sheets

(56) References Cited

U.S. PATENT DOCUMENTS 4,716,838 A * 1/1988 Huon De Kermadec ..... B61B 12/12 104/173.1
5,406,891 A * 4/1995 Kunczynski ..... B61B 12/125 104/140
5,419,261 A * 5/1995 Tarassoff ..... B61B 9/00 104/173.1
5,595,122 A * 1/1997 Levi ..... B61B 9/00 104/173.1
5,732,635 A * 3/1998 McKoy ..... A63G 33/00 104/172.3
5,819,668 A * 10/1998 Meindl ..... A61B 9/00 104/168
5,860,364 A * 1/1999 McKoy ..... A63G 33/00 104/292
6,024,022 A * 2/2000 Toyre ..... B61B 12/125 104/173.1
6,237,499 B1 * 5/2001 McKoy ..... A63G 33/00 104/292
6,321,657 B1 * 11/2001 Owen ..... B61B 1/02 104/119
8,375,866 B2 * 2/2013 Heinzle et al. ..... 104/202
8,418,625 B2 * 4/2013 Czaloun ..... B61B 9/00 104/173.1
8,573,133 B2 * 11/2013 Mollet ..... 104/178
8,770,112 B2 * 7/2014 Mollet ..... E01B 7/00 104/130.07
2001/0017092 A1 * 8/2001 Mollet ..... B60V 3/04 104/23.2
2001/0037747 A1 * 11/2001 Svensson ..... B60L 13/06 104/120
2010/0180792 A1 * 7/2010 Bavaresco ..... B61B 12/10 104/178
2011/0226152 A1 * 9/2011 Mollet ..... B61B 9/00 104/178
2012/0017797 A1 * 1/2012 Mollet ..... B61B 9/00 104/130.01
2012/0090497 A1 * 4/2012 Fischer ..... E01B 25/15 104/130.06
2012/0125222 A1 * 5/2012 Heinzle ..... B61B 12/125 104/202
2013/0145954 A1 * 6/2013 Mollet ..... E01B 7/00 104/130.01
2014/0013992 A1 * 1/2014 Mollet ..... B61B 12/10 104/178
2014/0305331 A1 * 10/2014 Bavaresco ..... B61B 9/00 104/173.1

FOREIGN PATENT DOCUMENTS

EP 1193153 A1 4/2002
EP 2441636 A1 4/2012
FR 2500799 A1 9/1982
FR 2597424 A1 10/1987
FR 2658772 A1 * 8/1991 ..... B61B 9/00
FR 2942194 A1 8/2010

* cited by examiner

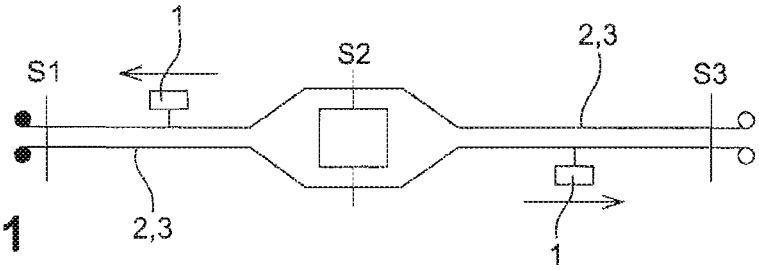
Fig. 1
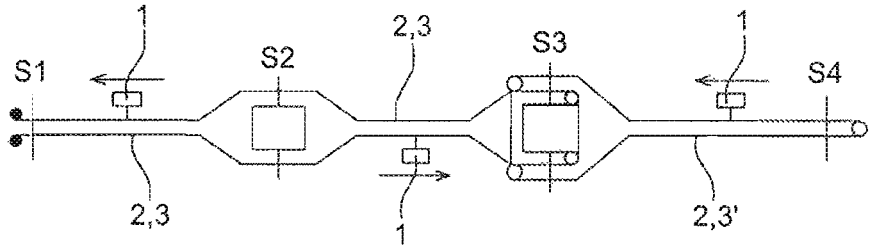
Fig. 2
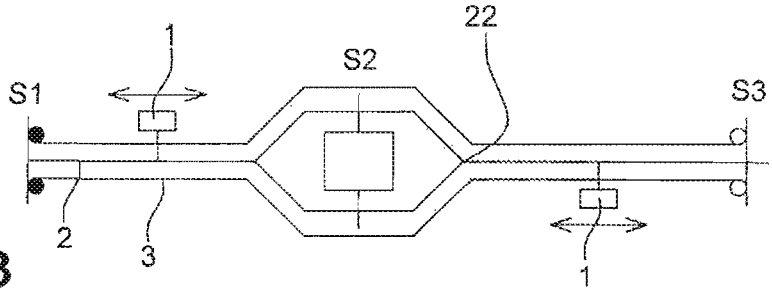
Fig. 3
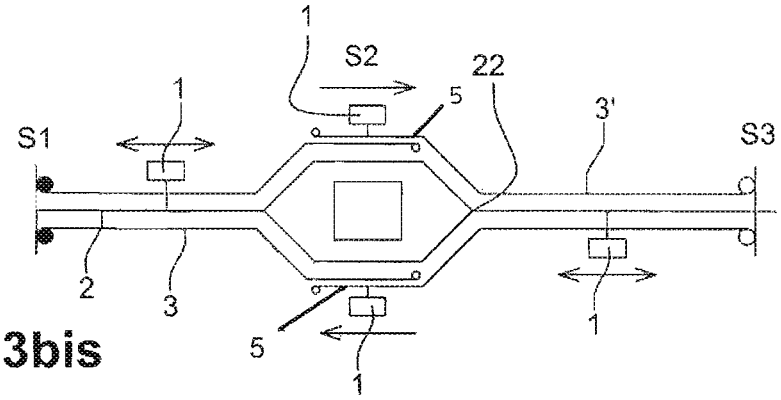
Fig. 3bis

CABLE TRANSPORT INSTALLATION

BACKGROUND

The present invention concerns cable transport installations such as trams, funicular railways or shuttles. There exist self-propelled systems, such as trains that are propelled by linear or non-linear electric motors or diesel engines, and cable traction systems.

This type of installation includes cars or wagons that necessitate traction means and support means to guide them. Guidance is most often achieved by two rails on which the car, which is equipped with wheels, travels. These rails provide guidance via two wheels. Depending on the system used, each rail is in contact with either one wheel or two wheels. Either each wheel rolls on a rail or the two wheels roll on either side of the same rail.

Traction is provided by one or more cables, each cable forming a closed loop running in the same direction or alternately in one direction and then the other, depending on the system used.

The car or wagon is connected to the cable either in a fixed manner or in a removable manner. When the car is connected to the cable in a fixed manner, the cable runs in a first direction to move the car from one terminal to the other and then in the opposite direction for the return journey. When the car is connected in a removable manner, as described in European patent EP 611 220, a fixing clamp enables the changeover from one cable to the other and thus changing cable either at the end of the line or mid-route in the case of so-called "long loop" systems in which there is a plurality of successive cables along the route, these changeovers constituting relays along the route, as it were.

These various systems lead to large infrastructures for guiding the cars and attempts have been made to reduce their overall size by using single-track systems. These systems necessitate the creation of passing areas, also known as "bypasses", so that at least two cars can travel at the same time. These passing areas are usually located at station stops.

However, these systems can necessitate complex switches to enable the cars to enter each passing area. When each wheel travels on its own rail, the switch must include two mobile rails to direct the wheels of each car and the switch is then heavy to manipulate and bulky.

Another system has been developed that consists in placing an auxiliary rail at the entry to the passing area; said rail is located on the outside to guide the outside wheel of the car from one side to the other, the inside wheel being temporarily unguided as far as the entry to the station.

If the car is guided by only one rail, the route comprises two rails each dedicated either to the outward journey or to the return journey, the car changing rail at the end of its route (at the termini).

The drawback of these types of systems is that they necessitate at least one continuous lateral wall over the whole of the route of the car in order to place the guide rail or rails thereon, which leads to a greater overall size. The space available for installing these transport systems can be limited if they must be inserted into existing streets and enable circulation of other vehicles and pedestrians.

SUMMARY OF THE INVENTION

The object of the present invention is to propose a transport system that is both simple and compact.

The transport system in accordance with the invention comprises a car for receiving passengers, a guidance system and a cable traction system, and is characterized in that the guidance system consists of a single central rail (i.e. a rail located in the middle of the car) with which cooperate elements such as wheels attached to the car, for example, or skids if the train moves at low speed. Thus there is no longer any lateral wall to support the guide rail or rails, which makes it possible to limit the width of the roadway neutralized by the system. The wheels of the car may be situated laterally on either side of the central rail.

According to one particular feature, the traction system is disposed on at least one side of the car. Each car is therefore pulled by a cable situated beside the track, which represents much less of a penalty than the rail because this cable requires only localized support, which necessitates the installation of only supporting posts, and not a wall.

According to one particular feature, the traction system may comprise two cables disposed one on each side of the car. In this case, each of these cables is assigned to one direction of travel of the car. This is the case in particular when there is a single track and avoidance arrangements so trains can pass each other.

In one variant, the car is attached to the cable of the traction system in a fixed manner. Thus each car has its own traction cable and if there is only one track the distance between cars and the way in which movement of the cars is controlled are defined so that the cars can pass only in passing areas when these are provided.

In another embodiment, the car is attached to the traction cable in a removable manner, by means of a clamp. The advantage of this configuration is that the cars can change cable either at the end of the route at the termini, to leave in the other direction, or mid-route in so-called "long loop" configurations.

In accordance with one particular feature, the traction cable forms a closed loop. The cable constitutes a closed loop running between two end pulleys and intermediate pulleys.

In a variant, the traction system comprises a plurality of closed loop cables having overlap areas. This is a "long loop" system, the overlap areas being used to transfer the car clamp from one of the cables to the other so that the car can continue to travel the next section.

In another variant, the car travels at least partially on a single track and said track comprises car passing areas in which the track is divided into two tracks. The advantage of a single track is the small overall size of the system. The cars pass each other in these passing areas, which are usually stations at which passengers can disembark from the cars. The car can also circulate entirely on a single track. A single track is conceivable with a central rail and a train operating in "shuttle" mode or a single track with a short circuit or "bypass" employing a central rail and two trains in "shuttle" mode or two parallel tracks, i.e. two single tracks with a central rail and a train in "shuttle" mode.

In accordance with one particular feature, the single track is divided into two tracks by a switch.

In a first variant, the switch is constituted of two blades each articulated to one of the two tracks. Each blade is articulated to one of the two tracks of the passing area and, depending on whether it is required to direct the car onto one or the other of the tracks, the blade corresponding to the track onto which the car is to be transferred is made continuous with the single track.

In a second variant, the switch is constituted of two rigid blades connected to each other by at least one crosspiece. The blades are connected in a convergent manner on the crosspieces; the assembly of the two blades and the crosspieces is able to slide to make one of the two blades continuous on one side of the switch with the single track and on the other side of the switch with one of the tracks of the passing area.

In accordance with one particular feature, the car is mounted on air cushions. If the car is guided not by rolling on rails but by lateral contact of the wheels on the rail, the car must be supported in order to move, which support is in this case provided by means of air cushions.

The invention also covers other modes of movement such as a pneumatic mode.

BRIEF DESCRIPTION OF THE DRAWINGS

Other advantages will become more apparent on reading the following detailed description given by way of nonlimiting illustration and with reference to the appended drawings in which:

FIG. 1 represents a system with two tracks, a station at each end and a central station, FIG. 2 represents a system with two tracks and a relay station in addition to the FIG. 1 system, FIG. 3 represents a shuttle mode system with one track, a station at each end and an optional central station, FIG. 3*bis* represents a "long loop" system with one track, one station at each end and at least one intermediate relay station.

DETAILED DESCRIPTION OF THE PREFERRED EMBODIMENT(S)

Figure 4A:
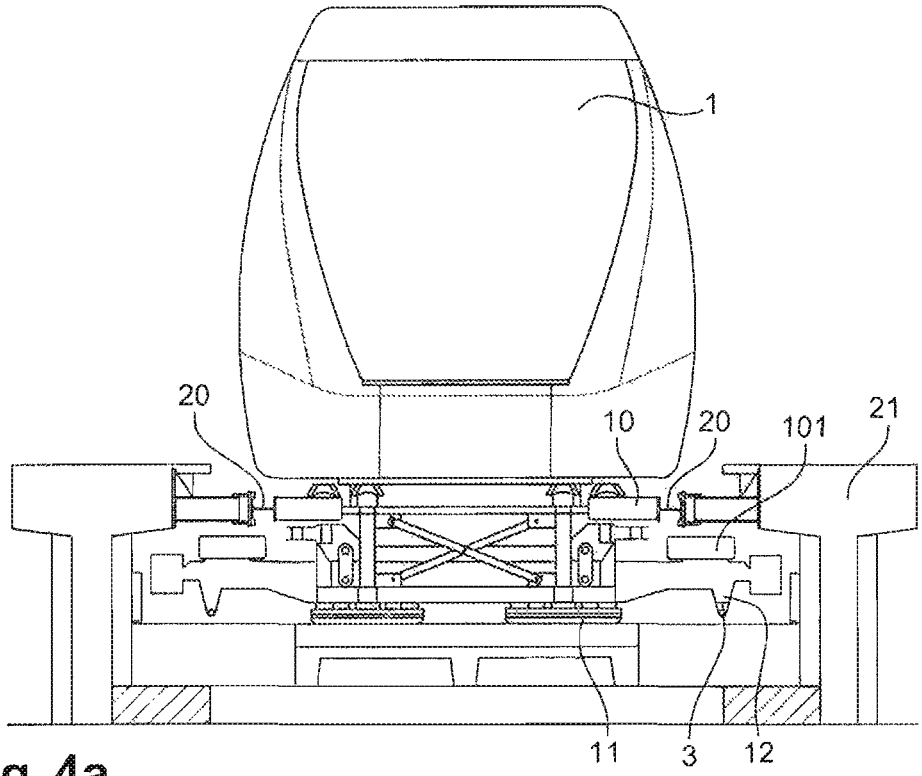
FIG. 4*a* represents a front view of a first prior art car with two lateral guide arrangements per vehicle.

FIG. 1 shows a simple system in which each car 1 has its own cable and its own track 2. One or more stations S2 are placed on the route.

FIG. 2 shows a variant of the previous system in which the route is defined by a plurality of cables 3, 3'. To optimize the traction of the cars 1 the cable 3 must be sufficiently taut to pull the car or cars 1 and from a certain length this tension is no longer achieved, so that a second cable 3' must be provided to pull the cars 1 over the next part of the route. It is therefore possible to provide a route of any length by adding a new cable 3' each time. In this case, the car 1 passes from one cable to the other in a station S3 by means of a removable clamp (not represented), as shown in FIG. 3*bis*.

FIG. 3 shows a system with a plurality of cars 1 and a single track 2 with one or more stations S2 that serve as a passing area for cars traveling in opposite directions.

FIG. 3*bis* shows a variant of the previous system known as a "long loop" system in which an intermediate station S2 enables the car 1 to pass from a first cable 3 to a second cable 3' in the overlap area 5.

In FIG. 4*a* there is seen a car 1 with two horizontally disposed guide rails 20 on each of which rolls a wheel 10. The car 1 is thus equipped with wheels 10 disposed under the car 1 but the rotation axis of which is vertical, enabling each of the wheels 10 to roll on the horizontally disposed rails 20. Traction is provided by a cable 3 situated laterally relative to the track and supported by pulleys 30 placed at the side of the track. The car 1 moves on two air cushions 11. A third wheel 101 also located under the car and on the outside of one of the two wheels 10 enables the car 1 to be guided in the passing areas at the stations. The car 1 is connected to the cable 3 by a clamp 12.

Figure 4B:
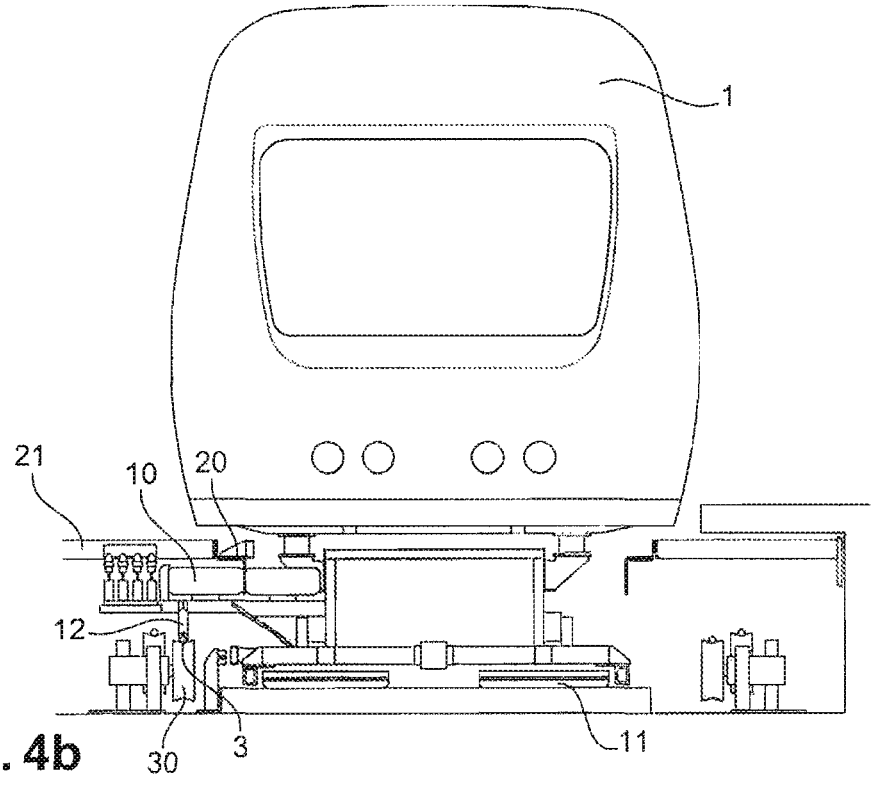
FIG. 4*b* represents a front view of a second prior art car with one lateral guide arrangement per vehicle.

The car 1 shown in FIG. 4*b* includes two wheels 10 disposed under the car 1 with a vertical rotation axis, the two wheels 10 rolling on a single rail 20 disposed vertically. Traction is provided by a cable 3 placed on the outside of the track of the car 1, and said cable is supported by pulleys 30 located at the side of said track and along the latter. The car 1 is connected to the cable 3 by a clamp 12. The principle of this system is described in French patent FR 2 942 194.

Figure 4C:
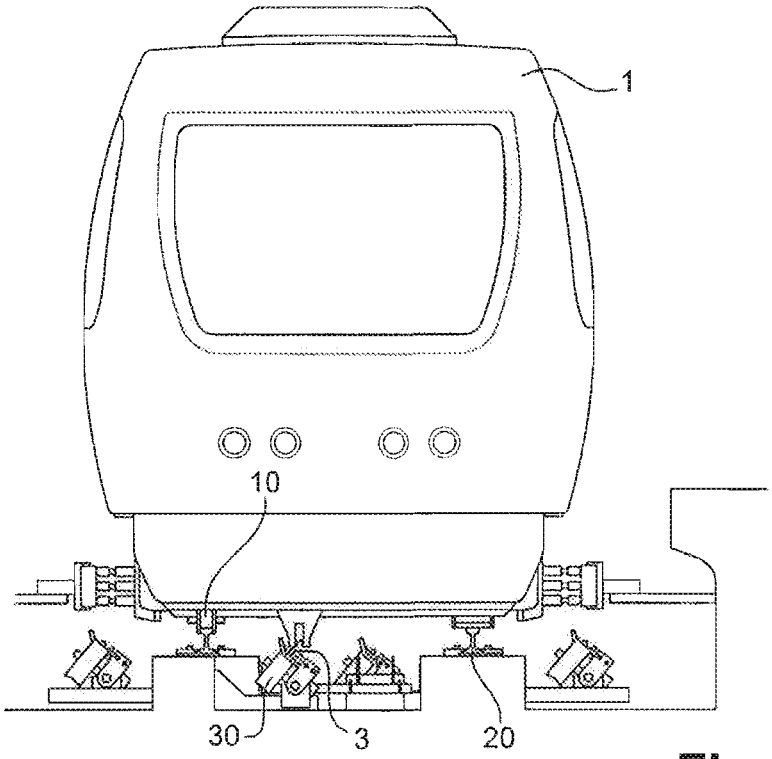
FIG. 4*c* represents a front view of a third prior art car.

In FIG. 4*c*, the car 1 has steel wheels 10 disposed under said car 1 and with a horizontal rotation axis. The rails 20 are disposed vertically and the wheels 10 roll on the rails 20 in the conventional way. Traction is provided by a cable 3 placed between the two wheels 10, and said cable is supported by a pulley 30 located under the car 1 between the two guide rails 20. The car 1 is connected to the cable 3 by a clamp 12.

Figure 4D:
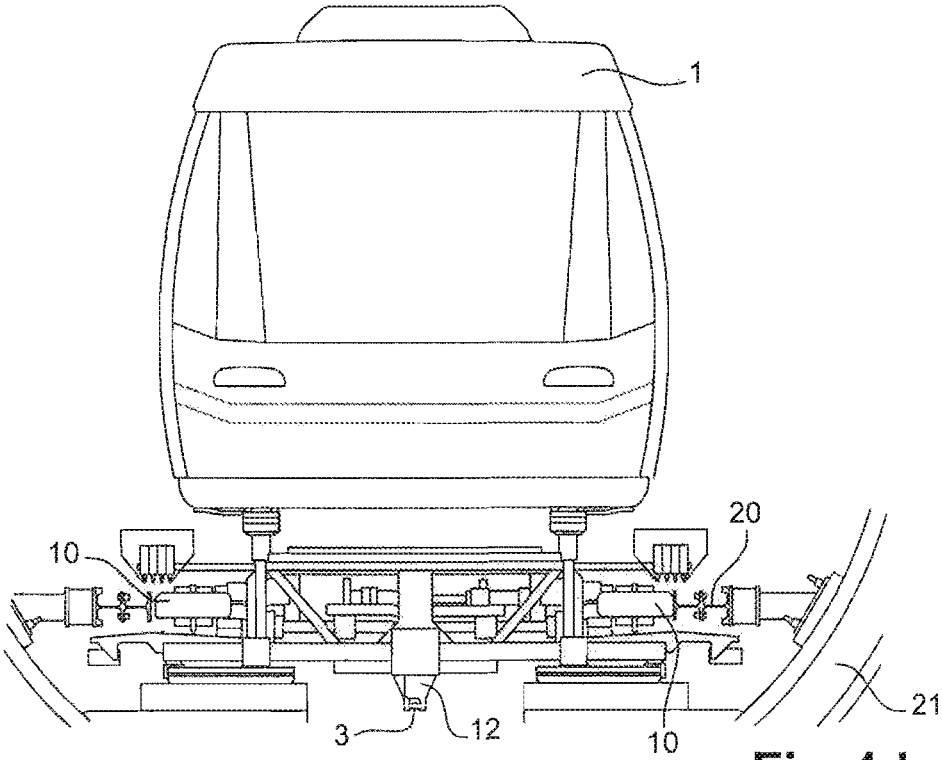
FIG. 4*d* represents a front view of a fourth prior art car with two lateral guide arrangements per vehicle.

The car 1 shown in FIG. 4*d* has two wheels 10 disposed under said car 1 and with a vertical rotation axis. These wheels 10 cooperate with guide rails 20 placed laterally at the side of the track. Traction is provided by a cable 3 placed under the car 1. The car 1 is connected to the cable 3 by a clamp 12.

It can be seen that a number of these embodiments necessitate lateral rails 20 placed outside the track. These rails 20 are fixed to a lateral wall 21 that runs all along the track.

Figure 5:
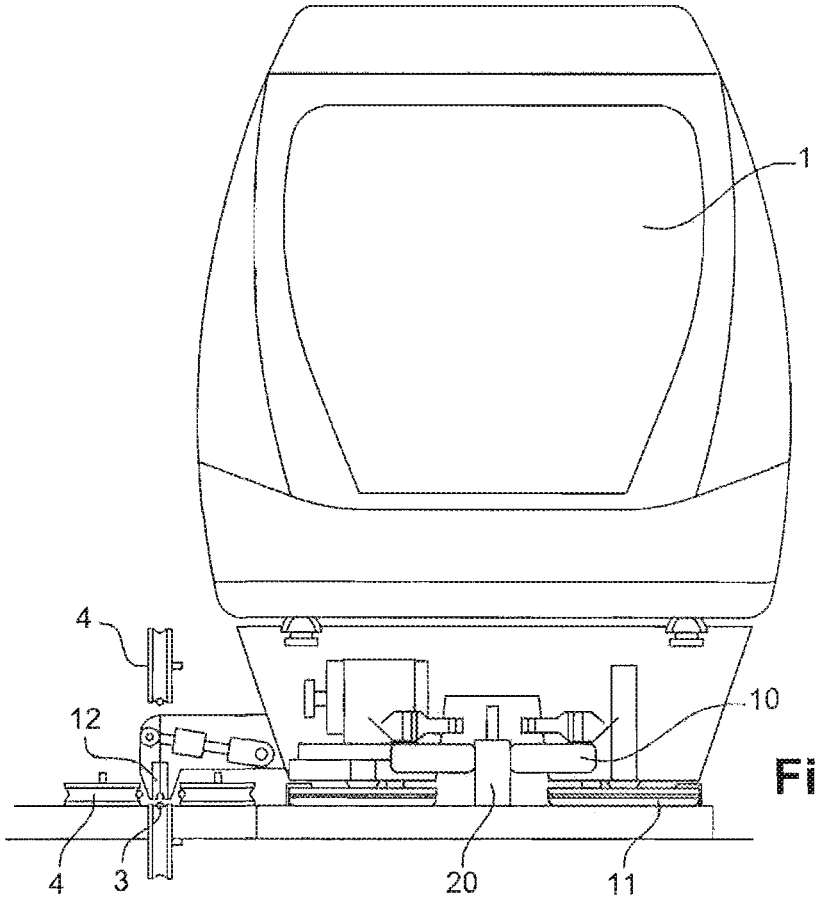
FIG. 5 represents a front view of a car in accordance with the invention.

FIG. 5 shows a car in accordance with the invention in which the guide rail 20 is a central rail. Two wheels 10 attached to the car 1 roll one on each side of the rail 20. An air cushion 11 enables the car 1 to move. Traction is provided by a cable 3 to which a clamp 12 is attached. The clamp 12 is fixed to one side of the car 1. The cable is supported by pulleys 4.

It is possible without departing from the scope of the present invention to use either wheels with tires or iron wheels.

Figure 6:
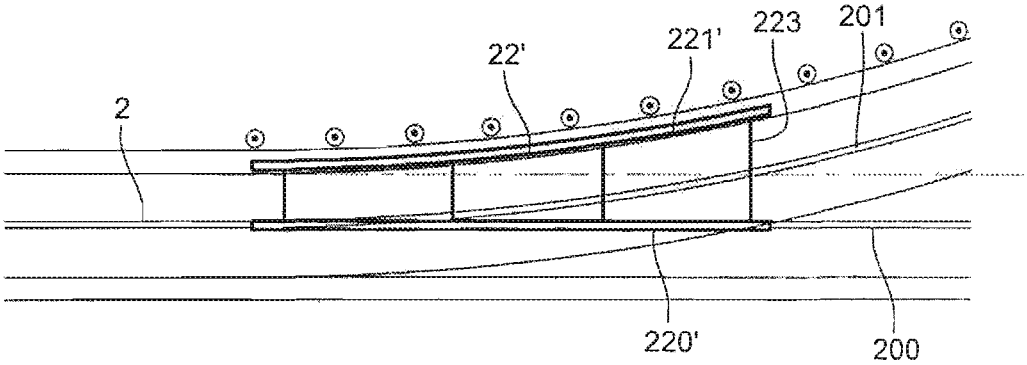
FIG. 6 shows a first switch variant in a first position.
Figure 7:
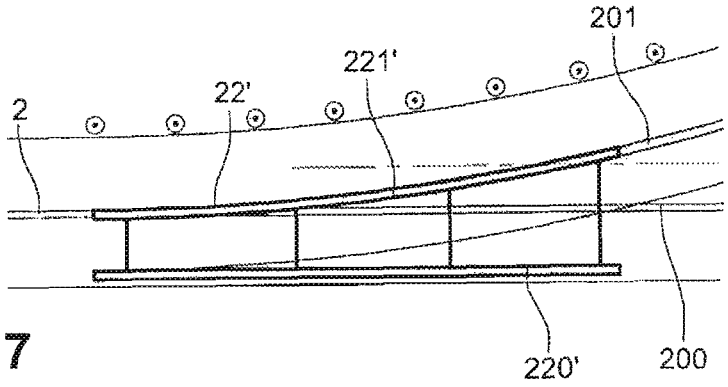
FIG. 7 shows the same first switch variant in a second position.

FIGS. 6 and 7 show a switch 22' mobile in translation between a position in which the rail 220' is in line with the rail 200 (FIG. 6) and a second position in which the rail 221' is continuous with the rail 201 (FIG. 7). The switch 22' is placed in one of these two positions as required. The two rails 220' and 221' are connected to each other by at least one crosspiece 223.

Figure 8:
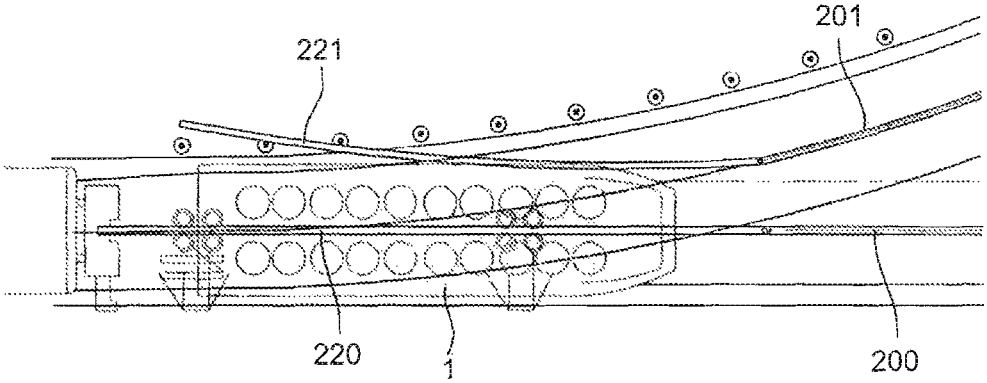
FIG. 8 shows a second switch variant in a first position.
Figure 9:
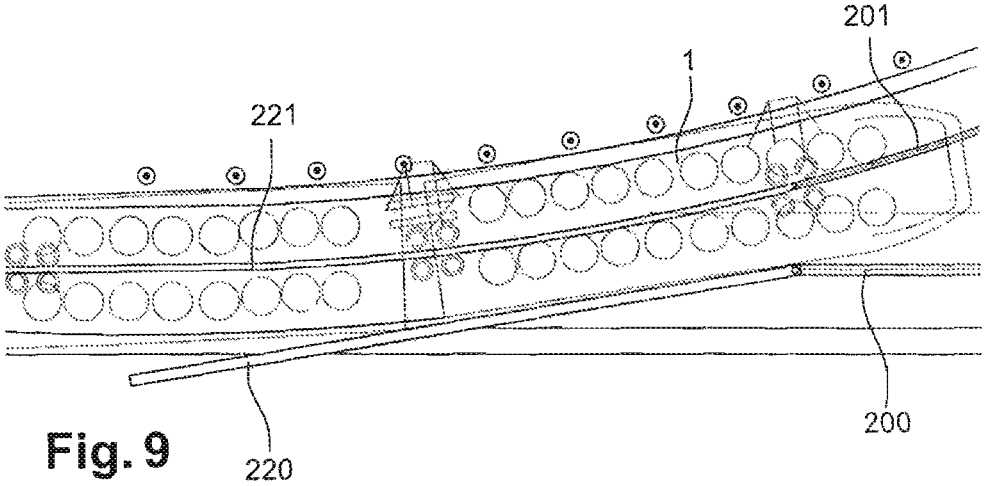
FIG. 9 shows the second switch variant in a second position.

The switch 22 shown in FIGS. 8 and 9 is constituted of two rails 220 and 221 that are articulated at the entry to a station S2 or S3 to the rail 200 or 201, respectively, in the station. The switch is controlled electrically, for example as shown in FIGS. 8 and 9. The switch may be controlled by means of at least one crosspiece 223 to which each of the rails 220 and 221 is fixed.

The mode of travel of the cars 1 in accordance with the invention will now be described.

The cars 1 leave a terminus or an intermediate station S2 guided by the central rail 20 and pulled by a cable 3 located on the right-hand side of the track, for example. On approaching a station S2 or a passing area a switch 22 placed at the entry directs a first car 1 to the side of the station S2 on which the cable 3 is located, in the preceding example the right-hand side. At the exit from the station, the switch 22 at the exit, which was positioned to direct a second car 1 traveling in the opposite direction onto the other side of the station S2, is moved to redirect the car 1 onto the central rail 20 after leaving the station S2.

In the case of a "long loop" track, some stations S3 also serve to transfer the clamp of the car 1 when stopped from a cable 3 to a cable 3'.

The invention claimed is:

1. A transport system comprising a car for receiving passengers, a guidance system and a cable traction system, wherein the guidance system is constituted of a single central rail on which roll wheels attached to the car, wherein the car travels at least partially on a single track and said track includes passing areas in which the track is divided into two tracks, wherein the single track is divided into two tracks by a switch.

2. The transport system according to claim 1, wherein the cable traction system is disposed on at least one side of the car.

3. The transport system according to claim 1, wherein the traction system comprises two cables disposed one on each side of the car.

4. The transport system according to claim 1, wherein the car is attached to a cable of the cable traction system in a fixed manner.

5. The transport system according to claim 1, wherein the car is attached to a traction cable in a removable manner.

6. The transport system according to claim 1, wherein the cable traction system comprises a cable which forms a closed loop.

7. The transport system according to claim 1, wherein the cable traction system comprises a plurality of closed loop cables with overlap areas.

8. The transport system according to claim 1, wherein the switch is constituted of two rails each articulated to one of the two tracks.

9. The transport system according to claim 1, wherein the switch is constituted of two rigid rails connected to each other by at least one crosspiece.

10. The transport system according to claim 1, wherein the car is mounted on air cushions.

11. The transport system according to claim 1, wherein the wheels comprise two wheels configured to roll on each side of said single central rail.

12. A transport system comprising a car for receiving passengers, a guidance system and a cable traction system, wherein the guidance system is constituted of a single central rail on which roll wheels attached to the car, wherein the wheels comprise two wheels configured to roll on each side of said single central rail, wherein the cable traction system comprises two cables disposed one on each side of the car.

13. A transport system comprising a car for receiving passengers, a guidance system and a cable traction system, wherein the guidance system is constituted of a single central rail on which roll wheels attached to the car, wherein the cable traction system comprises two cables disposed one on each side of the car.

* * * * *